United States Patent [19]

Gasser et al.

[11] 4,357,793

[45] Nov. 9, 1982

[54] SLIVER-PROCESSING FRAME HAVING DRAWING ROLLERS

[75] Inventors: Hermann Gasser, Zurich; Karl Curiger, Pfäffikon; Peter Novak, Winterthur, all of Switzerland

[73] Assignee: Luwa AG, Zurich, Switzerland

[21] Appl. No.: 164,067

[22] Filed: Jun. 30, 1980

[30] Foreign Application Priority Data

Jul. 6, 1979 [CH] Switzerland ..... 6333/79

[51] Int. Cl.[3] ..... D01H 11/00; D01H 5/18

[52] U.S. Cl. ..... 57/304; 19/263; 57/90; 57/308; 57/315

[58] Field of Search ..... 57/301, 304, 305, 308, 57/315, 90; 19/200, 245, 246, 262–265; 15/306 A

[56] References Cited

U.S. PATENT DOCUMENTS

| | | | |
|---|---|---|---|
| 2,924,063 | 2/1960 | Datwyler | 57/304 |
| 3,070,948 | 1/1963 | Tsuzuki | 57/315 X |
| 3,287,768 | 11/1966 | Rakhorst | 19/200 |
| 3,359,713 | 12/1967 | Keyser | 19/246 |
| 3,377,665 | 4/1968 | Kincaid | 15/306 A X |
| 3,387,318 | 6/1968 | Nagel et al. | 15/306 A |

*Primary Examiner*—John Petrakes

*Attorney, Agent, or Firm*—Werner W. Kleeman

[57] ABSTRACT

For automatic feeding of slivers through drawing rollers there is provided a sliver-processing frame having drawing rollers, tubes for conveying slivers to be drawn and a plurality of suction elements connected to a common source of low pressure wherein the drawing rollers are enclosed in a casing of which the interior is connected to the source of low pressure the casing having inlet orifices for admitting cleaning air to the surfaces of the drawing rollers, one end of each tube leading into the casing.

11 Claims, 3 Drawing Figures

SLIVER-PROCESSING FRAME HAVING DRAWING ROLLERS

CROSS REFERENCE TO RELATED CASE

This application is related to the commonly assigned copending United States Applications Ser. No. 06/164,066, filed June 30, 1980, Ser. No. 06/164,068, filed June 30, 1980, Ser. No. 06/164,292, filed June 30, 1980 and Ser. No. 06/164,321, filed June 30, 1980.

BACKGROUND OF THE INVENTION

The invention relates to a sliver-processing frame having drawing rollers, particularly, though not exclusively, a flyer spinning frame.

For the delivery of sliver material to roving frames it is known to provide pneumatically operating conveying lines between the cans containing the sliver material and the frame. A conveying tube, which is connected at the delivery end to a low pressure source, is provided for each sliver, and the low pressure supply is connected to a chamber which is provided at the end of the tube and in which the sliver is separated from the conveying air, whilst on the other hand the admission of atmospheric air through the sliver outlet orifice is prevented by a suitable seal.

The disadvantage of conveying means of this type for the delivery of material to frames is that, before a can for the supply of material is started, or when it is fully used, each sliver must be passed by hand separately through the associated sealing means and delivered to the frame, which results in undesirably long downtime.

SUMMARY OF THE INVENTION

The object of the invention is to provide a roving frame in which the pneumatically conveyed sliver can be delivered automatically to the frame.

According to the present invention there is provided a sliver-processing frame having drawing rollers, tubes for conveying slivers to be drawn and a plurality of suction elements connected to a common source of low pressure wherein the drawing rollers are enclosed in a casing of which the interior is connected to the source of low pressure, the casing having inlet orifices for admitting cleaning air to the surfaces of the drawing rollers, one end of each tube leading into the casing.

With this invention, the manual work required during the removal of material from the pneumatic conveying system is avoided by delivering the sliver directly into a casing which encloses the drawing rollers and in which there is prevailing low pressure. Moreover, constructional costs can also be reduced because the same source of low pressure can be used both for cleaning the drawing rollers and for producing the stream of conveying air.

BRIEF DESCRIPTION OF THE DRAWINGS

The invention will be more clearly understood from the following description, given by way of example only, with reference to the accompnaying drawings in which.

DETAILED DESCRIPTION OF THE PREFERRED EMBODIMENTS

Figure 1:
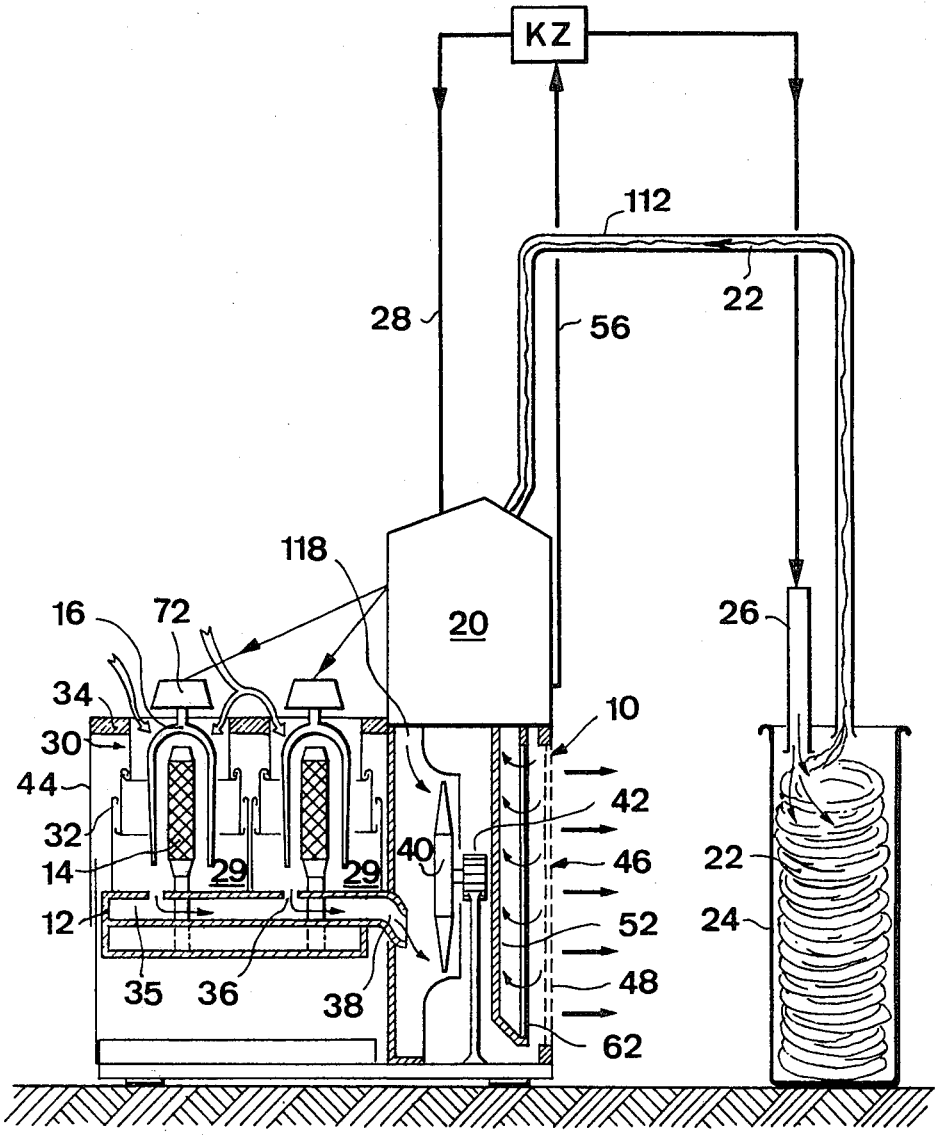
FIG. 1 shows a flyer spindle frame in diagrammatic cross-section.
Figure 3:
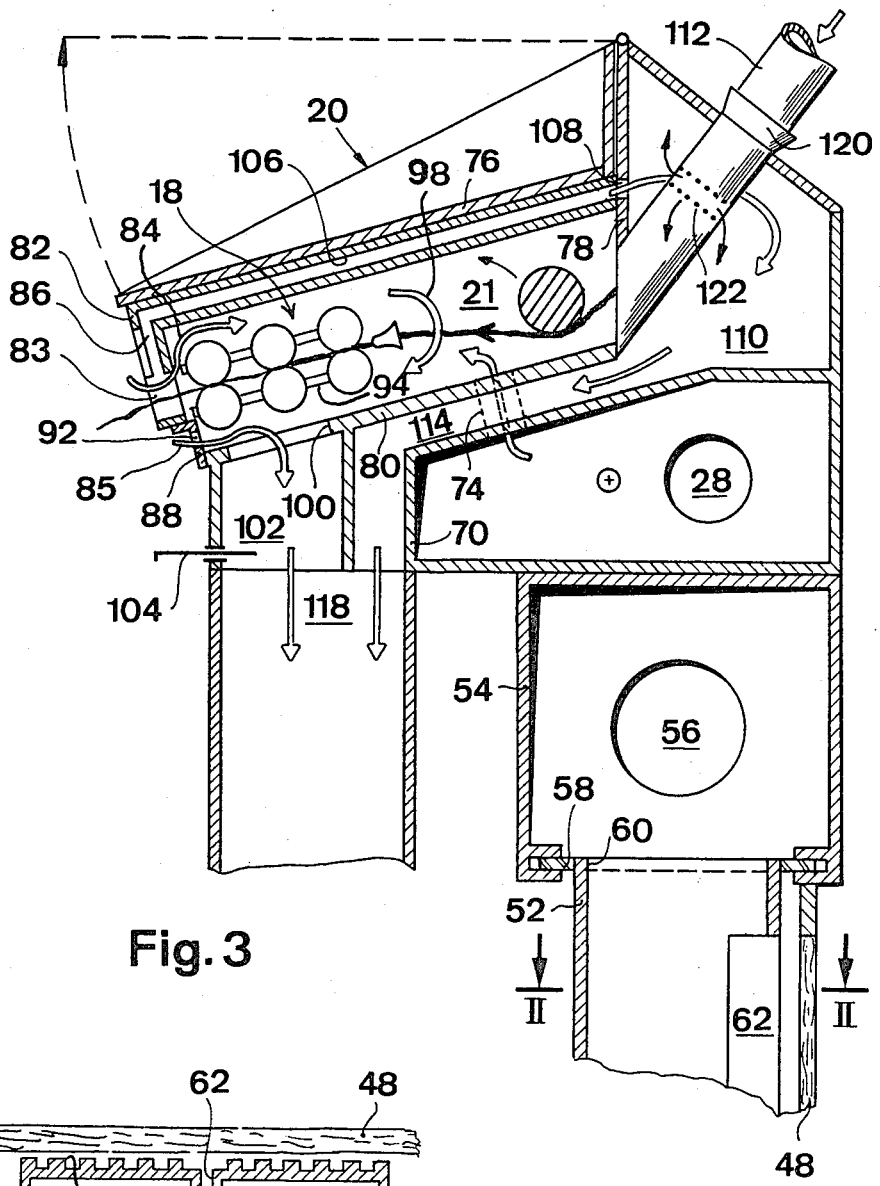
FIG. 3 shows, on an enlarged scale, part of the frame of FIG. 1.

Generally designated at 10 in FIG. 1 is a flyer spinning frame which comprises a spindle rail 12, a plurality of spindles of which two are shown at 14 and drawing rollers 18 of a drawing frame shown in FIG. 3 and located in a drawing zone generally designated at 20 in the Figures. Cans 24, one of which is shown, are filled with a draw sliver 22 to be processed. Conditioner air is fed from an air-conditioning unit KZ through pipes 26 and 28 to the cans 24 and the flyer spinning frame 10.

As shown in FIG. 1, each of the spindles 14 is arranged, together with its flyer 16, in a separate chamber 29. The chambers 29 are limited by approximately circular sleeves 30 each formed by a plurality of rings 32 which can be moved telescopically within one another. The sleeves 30 are open at the top and their axial length can be varied according to the lift of the spindle rail 12. The lowest ring 32 of each sleeve 30 is attached in airtight manner to the spindle rail 12 which has a duct section 35 for each sleeve 30 or, as shown, each adjacent pair of sleeves. The upper side of the duct section 35 has an inlet orifice 36 located inside the corresponding ring 32. The duct sections in the spindle rail 12 and therefore the chambers 29, that is the sleeves 30, are in turn connected by flexible tubes 38 to the suction side of a ventilating fan 40 which is driven by a motor 42.

The rings of the sleeves 30 are each secured in a common support or retaining flame 34 which is vertically movable, but which is kept stationary during operation of the flyer spinning frame 10. A telescopic covering shutter 44 extends down from the front edge of the retaining frame 34 to the spindle rail.

The rear wall 46 of the flyer spinning frame 10 is at least partially formed by a filter 48 which comprises a large proportion of the wall and through which air from the delivery side of the ventilating fan 40 flows into the spinning room.

Figure 2:
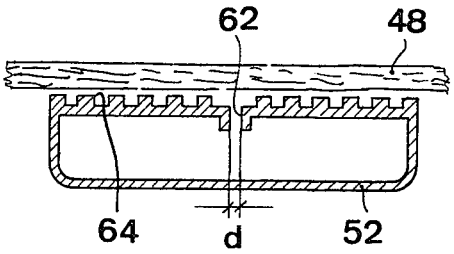
FIG. 2 is a section along line II—II in FIG. 3.

In order to remove dust and fibres from the filter 48, there are provided pneumatic cleaning means comprising a suction arm 52 which is movable along the inside of the filter 48. The suction arm 52 leads into an air duct 54 (FIG. 3) which extends along the flyer spinning frame 10 adjacent the rear wall 46. The air duct 54 is connected by a line 56, and preferably via a pressure reducing means, to the suction side of the air-conditioning unit KZ. Part of the bottom of the air duct 54 consists of a flexible band 58 which is movable in the longitudinal direction of the duct 54 and which covers a longitudinal slot in the bottom of the duct 54. The band 58 is reciprocated by a suitable drive (not shown). The suction arm 52 is attached to the band 58, the interior of the suction arm 52 being connected via an orifice 60 to the duct 54 for admission of air thereto. As shown in FIGS. 1 and 2, the suction arm 52 has a longitudinal suction slot 62 having a width d, this slot extending over the entire height of the filter 48. Preferably, and as shown in FIG. 2, the cross-section of the suction arm 52 is rectangular, and on both sides of the suction slot 62 and adjacent to the surface of the filter 48 there are sealing baffles 64, which cause air to flow into the suction arm through the filter 48 from its clean air side. The overall width of the suction arm 52 in its direction of movement, is preferably several times greater than d in order to achieve an effective sealing action and prevent the lateral admission of suction air.

In FIG. 3 the drawing zone 20 is shown in detail and on an enlarged scale compared with FIG. 1.

Sets of drawing rollers 18, of which one is shown, are supported in a manner not shown in detail, above an air duct 70 which extends, adjacent to the rear wall 46, along the flyer spinning frame 10 at about the height of upper bearings 72 of the flyers 16. An end of this duct 70 is connected to the air-conditioning unit KZ by a pipe 28 so that conditioned air is fed to the duct. The drawing zone of each set of drawing rollers 18 is connected to the duct 70 by an offset duct 74 so that drawing of the fibres takes place in an air-conditioned atmosphere.

In the zone 20 is a casing 21 defined at the top by a hinged lid 76, at the rear by a wall 78 and at the bottom by the wall 80 through which the offset ducts 74 pass. The front of the casing is formed by a wall section 82, which is attached to the lid 76 and which has for each roving an opening 83 which serves as an inlet orifice for admitting cleaning air to the upper drawing rollers (arrow 84). The wall section 82 also contains an inlet orifice 86 for the removal, by suction of any broken sliver or roving through an air line 106. The remaining part of the front of the casing is formed by a wall 88 which can be swung forwards and downwards and which contains an an inlet orifice 92 for admitting cleaning air as indicated by arrow 85 to the delivery rollers, that is the outlet rollers of the drawing frame.

Strippers associated with the drawing rollers to remove fibres therefrom, and which are not shown, are subjected to the streams of air which flow in the directions of the arrows 84, 85 and which also convey the stripped fibres. Between the drawing rollers there are provided baffles 94 which at least partly prevent the downward passage of air from the stream designated by the arrow 84 between the rollers. As a result, the greater part of the cleaning air sucked through the opening 83 passes to the rear of the casing 21, over the upper drawing rollers, round the intake rollers of the drawing frame and forward again under the lower drawing rollers, as shown by arrow 98. This cleaning air, together with the air (arrow 85) which has been admitted through the orifice 92, then flows through an orifice 100 in the wall 80 into a duct 102 which leads to the ventilating fan 40 via a duct 118. In the duct 102 there is provided an adjustable shutter 104 with which it is possible to control the quantity of air flowing therein.

For removing broken slivers or rovings by suction there is provided, in addition to the air line 106 extending through the hinged lid 76, an orifice 108 in the wall 78 of the casing, which is also a wall of a housing 110 arranged above the duct 70. The housing 110 is connected by a duct 114 to the ventilating fan 40, again via the duct 118.

Leading into the rear wall 78 of the casing 21 is a conveying or transport tube 112 for a sliver to be processed, which leads from the can 24. It will be appreciated that the connections between the ventilating fan 40 and, firstly, the interior of the casing 21 and, secondly, the interior of the housing 110, extend initially separately from one another before combined in duct 118 so that it is possible to set different pressures in these regions, for example, to set a lower pressure in the housing 110 than in the casing 21.

Where the tube 112 enters the housing 110, there is an injector 120 for feeding in the sliver. Where it extends through the housing 110, the conveying tube 112 has outlet orifices 122 for the conveying or transport air which can therefore be at least partially removed before the sliver emerges from the conveying tube into the chamber of the casing 21.

In order to operate the flyer spinning frame 10, the draw sliver 22 in the can 24 is placed near the opening of the conveying tube 122 which is near to the can 24, and the injector 120 is operated for a short period. This results in the sliver 22 being conveyed into and through the conveying tube 112 and passed as far as the intake rollers of the drawing frame 18. It can then be fed in by hand and subsequently threaded into the flyer. During operation of the frame, conditioned air passes through the pipe 26 into the can 24 so that it is possible to achieve pre-conditioning of the sliver, which helps in subsequent processing, particularly drawing. Conditioned air is also passed through the pipe 28, the duct 70 and the offset passages 74 to the drawing rollers 18 so that the most favourable conditions for processing the sliver occur also at these points. Meanwhile, the ventilating fan 40 causes the conveying air which carries the sliver from the can 24 to be sucked through the conveying tube 112, and this continually carries the sliver from the can 24 to the drawing rollers 18. It is, in fact possible to feed conditioned air only to the drawing rollers, rather than to the can as well. This has the advantage of a longer time of air residence at the drawing zone which can be particularly important in the case of higher sliver speeds and correspondingly short residence times between the drawing rollers.

The conveying air flows from the tube 112 through the orifices 122 into the housing 110, and passes through the ducts 114 and 118 to the ventilating fan 40. The air for cleaning the drawing rollers 18 flows into the casing 21 through the openings 83 and the orifices 92 around the delivery rollers, flows around the strippers and finally passes, together with the initially conditioned air stream from the duct 114, through the duct 118 to the ventilating fan 40. The air which is sucked through the orifices 86 into the line 106 for removing broken rovings by suction also flows into the housing 110 and through the ducts 114 and 118 to the ventilating fan 40.

When the supporting or retaining frame 34 and the sleeves 30 are lowered upon filling of the bobbins, so as to allow replacement of the full bobbins with empty bobbins, the sleeves 30 and the covering shutter 44 telescope, and the bobbins mounted on the spindles 14 become accessible. Meanwhile ambient air is still sucked from above through the sleeve 30 in the direction of the double arrows of FIG. 1. This suction air also conveys dust released from the bobbin presser, and it passes through the air-conducting elements in the spindle rail 12 to the ventilating fan 40, to be blown out therefrom into the spinning room through the filter 48. The deposit forming on the filter 48 from this and other sources is removed by the moving suction arm 52 and fed via the duct 54 and the line 56 to the air-conditioning unit KZ and collected therein.

As the filter 48 extends over a major part of the length of the frame, and over a considerable part of the rear wall, a large surface area is provided to clean the air without a significant loss of pressure. The air is ejected at a comparatively low velocity.

Although the ventilating fan 40 has been shown as associated with the frame described, where several frames are located together it is possible to provide one, or more, common low pressure sources, e.g. a single but larger low pressure fan. In such a case the filter 48 and associated cleaning devices will be replaced with a central separator associated with the common low pressure source.

While there are shown and described present preferred embodiments of the invention, it is to be distinctly understood that the invention is not limited thereto, but may be otherwise variously embodied and practiced within the scope of the following claims. Accordingly,

We claim:

1. A sliver processing frame, comprising:

at least one set of drawing rollers;

at least one conveying tube for conveying a sliver to the drawing rollers;

a casing enclosing the drawing rollers;

means constituting a negative pressure source operatively connected with the casing;

said conveying tube being operatively connected to the casing;

means for admitting cleaning air to the casing and the drawing rollers;

said means constituting said negative pressure source comprising a common source for casing cleaning air to enter the casing via the cleaning air admitting means and for generating an air flow in the conveying tube for transporting the sliver through the conveying tube to the drawing rollers; and means connecting said common source with said casing.

2. A frame as claimed in claim 1, further including means defining an air path for connecting said tubes to said common source, said air path by-passing said casing.

3. A frame as claimed in claim 1 including outlet orifices provided in said conveying tubes upstream of said casing, a housing in which said outlet orifices are located, and means connecting said housing to said common source.

4. A frame as claimed in claim 3, wherein said means connecting said common source with said casing and said means connecting said common source to said housing extend, at least initially, separately from one another.

5. A frame as claimed in claim 3, further including a hinged lid provided for said casing, air lines and suction orifices for removing broken slivers in said lid and openings in said housing by which said air lines are connected to said common source.

6. A frame as claimed in claim 1 including an adjustable throttle in said means connecting said casing to said common source.

7. A frame as claimed in claim 1, further including and comprising a hinged lid provided for casing.

8. A frame as claimed in claim 7, further including air lines and suction orifices in said lid for removing broken slivers, said air lines leading to said common source.

9. A frame as claimed in claim 1, including a source of conditioned air to which at least the interior of said casing is connected.

10. A frame as claimed in claim 9, including a longitudinal duct connected to said source of conditioned air and passages leading from said duct to the interior of the casing.

11. A frame as claimed in claim 9, wherein the interior of said casing is directly connected to said source of conditioned air by said conveying tubes.

* * * * *